United States Patent [19]

Hockham et al.

[11] 4,258,365

[45] Mar. 24, 1981

[54] AROUND-THE-MAST ROTARY ANNULAR ANTENNA FEED COUPLER

[75] Inventors: George A. Hockham, Valencia; Ronald I. Wolfson, Northridge, both of Calif.

[73] Assignee: International Telephone and Telegraph Corporation, New York, N.Y.

[21] Appl. No.: 101,258

[22] Filed: Dec. 7, 1979

[51] Int. Cl.[3] ..... H01Q 3/00

[52] U.S. Cl. ..... 343/763; 333/261

[58] Field of Search ..... 343/761-763, 343/839, 854, 876, 106 R, 100 R; 333/128, 245, 261

[56] References Cited

U.S. PATENT DOCUMENTS

| | | | |
|---|---|---|---|
| 2,426,226 | 8/1947 | Labin et al. | 333/261 |
| 3,066,291 | 11/1962 | Alford | 333/261 |
| 3,123,782 | 3/1964 | Parisi | 343/763 |

*Primary Examiner*—David K. Moore

*Attorney, Agent, or Firm*—William T. O'Neil

[57] ABSTRACT

An annular rotary antenna feed coupler especially for around-the-mast use, as on shipboard. A housing in the general shape of a cylinder with a central axial opening essentially concentric with the axial center line of the housing contains a circumferential distribution of a number of fixed axially elongated, conductive loops each with a feed port. Radially spaced therefrom, a second, group of elongated conductive loops circumferentially distributed about a circle of different radius as compared to the aforementioned fixed loops is rotatably mounted. A corresponding plurality of ports, one for each rotating loop, is also provided, and input and output combiner/divider devices, one for the fixed and another for the rotating sub-assemblies serve to combine all ports into a single fixed and a single rotating port. Mechanically, the rotating combiner/divider rotates with the antenna array with which it operates.

12 Claims, 4 Drawing Figures

AROUND-THE-MAST ROTARY ANNULAR ANTENNA FEED COUPLER

BACKGROUND OF THE INVENTION

The invention relates to microwave systems generally, and more particularly to an RF feed operative between fixed transmit/receive apparatus and a rotating antenna array, or the like.

DESCRIPTION OF THE PRIOR ART

The general problem of providing a rotating RF transmission line joint between a rotating antenna system and fixed transmitter, receiver and signal processing apparatus is nearly as old as the radar art itself. Various forms of such rotating joints or couplings have been developed and are known in this art. A few of these include the rotating circular waveguide joint, the rotating coaxial coupling, and various hybrid arrangements in which there are one or more transitions from one transmission line medium to another.

The unique problem in shipboard radar arises when, for reasons intended to minimizing antenna blockage from ship superstructure, a rotating antenna is essentially mounted at the top of a mast. In such cases, it is particularly useful to provide some form of around-the-mast coupler, a part of which rotates with the antenna array and a part of which remains fixed for connection to the fixed apparatus, typically a transmitter, receiver and other signal processing equipment. One form of such a coupler is described in U.S. Pat. application Ser. No. 40,325 filed May 18, 1979, and is entitled "Around-The-Mast Rotary Coupler." That patent application is assigned to the assignee of the present application. In it, two matching, annular, cellular rings rotate with respect to each other. The cells of each of these rings are actually waveguide sections and energy transfer is effected during rotation.

One inherent problem associated with the aforementioned rotary coupler is this same fact, namely that the individual cells of the annular rings are in effect short sections of waveguides, and are therefore subject to the low frequency cut-off characteristic of waveguide. This means that, for relatively low microwave frequencies, the cross-sectional dimensions of these waveguide cells become relatively large. The result in size, weight and cost factors can be disadvantageous.

Of further interest in the prior art is U.S. Pat. application Ser. No. 77,850, filed Sept. 21, 1979 and entitled "Loop Coupler Commutating Feed." In that disclosure, the concept of fixed and rotating loops coupling to each other is presented and could be adapted to the rotary coupler use, however its diameter is relatively large since the loops are radially oriented. More importantly, however, it is not adapted to the around-the-mast configuration, and is essentially useful as background hereto because of the basic, coupled, elongated loop concept which it discloses in common with the invention herein.

Also of interest is backgound is U.S. Pat. application Ser. No. 19,481, filed Mar. 12, 1979 and entitled "Large Scale Low-Loss Combiner and Divider." That device, which does not involve moving parts is not a coupler per se, and is not directly applicable to the around-the-mast rotary coupler application, but like the aforementioned U.S. Pat. application Ser. No. 77,850 employs magnetically coupled elongated loops in independent input/output groups.

All three of the aforementioned background patent applications are assigned to the same assignee as is the present invention.

In consideration of the background art and the particular problem to be solved, the manner in which the invention advances the state of this art will be understood as this description proceeds.

SUMMARY

It may be said to have been the general objective of the present invention to provide a compact, around-the-mast, rotary coupler for transferring radio frequency signals between the rotating antenna and fixed associated circuitry through magnetic loop coupling. The apparatus of the invention is constructed around a central axial opening of circular cross-section for around-the-mast installation. Within a conductive housing, an annular chamber is provided into which a first group of fixed, elongated, conductive loops are installed, these loops extending generally axially about the full 360° cross-section. A rotatable assembly provides a second group of similar loops, these being mounted on a rotatable assembly so that they revolve as a group about a common center with respect to the fixed loops in radial juxtaposition therewith. The fixed loops in the representative embodiment to be described hereinafter, are on the inside, i.e. laterally tangent to a smaller circle than are the rotating loops which are laterally tangent to a somewhat larger circle.

An "equal-path-length" feed arrangement is illustrated and described in connection with the implementation of a system employing the loop coupler part of the invention. The device of the invention is not subject to low frequency cut-off as is the case in waveguide devices, and accordingly can be constructed more compactly and with correspondingly higher bandwidth capability. Typically, a bandwidth of at least 50 percent is readily achievable. The power transfer between the fixed and rotating loop sets is relatively constant with rotation except for a periodic power ripple caused by reflected power due to the mismatch that occurs as the rotor loops pass over the gaps between adjacent fixed loops. If one loop set comprises relatively wide loops with minimum gaps between them circumferentially, the other set may be relatively narrow in their transverse or circumferential dimension and still provide relatively constant power transfer except for the aforementioned periodic ripple.

The details of an embodiment based on the principles of the invention will be described hereinafter.

DETAILED DESCRIPTION

Figure 1:
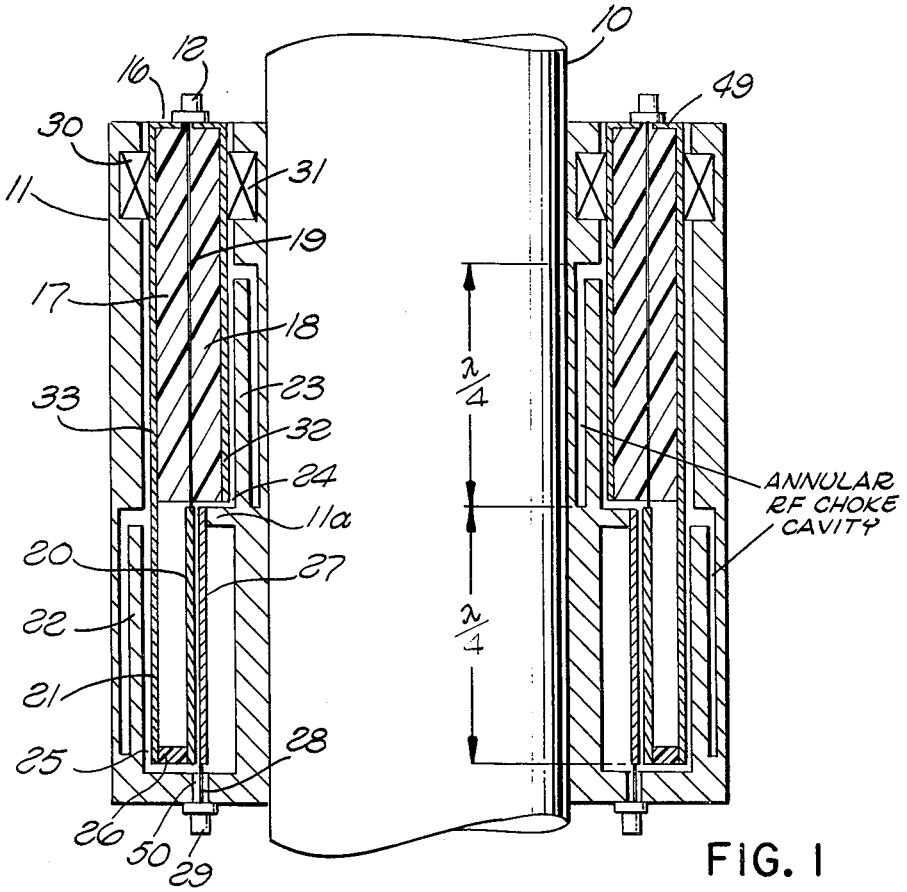
FIG. 1 is an axially sectioned view of a coupler according to the invention as it would be installed about a mast or column.

Referring now to FIG. 1, the apparatus of the invention will be seen in section with its axial cylindrical central opening emplaced over a mast 10. The housing 11 will be understood to be generally annular in a plane normal to the axial center line of the mast 10 and therefore to the axial center-line of the central axial cavity generally congruent with the mast 10 in the illustration of FIG. 1.

Figure 2:
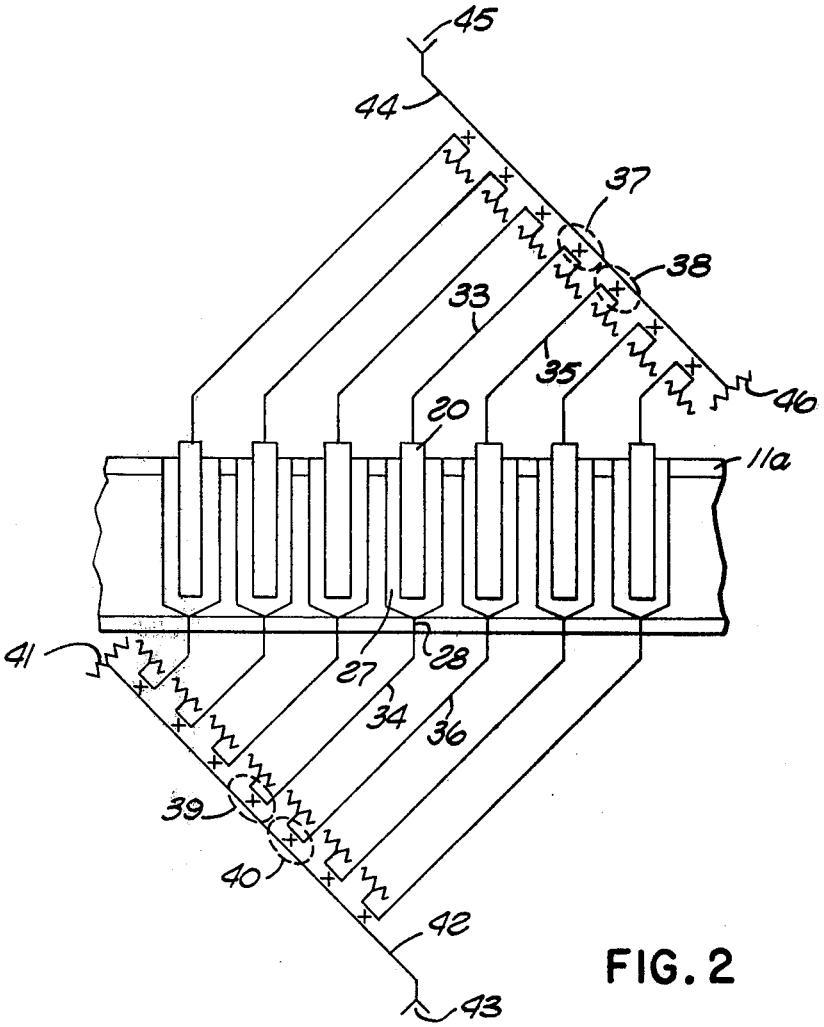
FIG. 2 is a flat development of a portion of the cylindrically disposed loop set corresponding to a radial view of FIGS. 1 and 1A with the housing removed.

The cross-section of the housing 11 on either side of the mast 10 will be seen to be generally U-shaped in an axial plane, i.e. without the rotating assembly generally identified at 16. Within this housing the fixed loops or stator loops are distributed circumferentially, typically at 27 in FIG. 1. The radially outward projection 11A forms a conductive pedestal for loop leg 27, the loop being also connected at the lower end to a coaxial center conductor 28 passing through a bore 50 in the bottom of housing 11, where an external port in the form of a coaxial connector 29 provides a connection thereto. The outer conductor of the coaxial connector 29 is electrically and mechanically connected to the housing 11 at that point and the radially inward wall of housing 11 forms a fixed loop return path. The coaxial connector 29 representing one of the fixed loop ports is one of the set of first ports referred to hereinafter. In FIG. 2, a development of the cylindrically distributed first or fixed loops as well as the rotating loops of the second loop set, typically 20 in FIGS. 1 and 2, is shown. The development showing of FIG. 2 may be considered to be a radially inward view taken in the absence of the extended conductive cylindrical shell 21 and the housing 11 radially outward wall. Further discussion of FIG. 2 will follow during and after the description of FIG. 1, as appropriate.

Considering now the rotating assembly generally at 16, this comprises what may be referred to as first and second axial sections, the first axial section, or lower part as depicted in FIG. 1, comprises the loop leg 20 with its conductive pedestal 26 connected to the conductive cylindrical shell extension 21. The second, or upper part, comprises the stripline section between conductive cylindrical shells 33 (from which 21 is extended) and 32 on the radially inward side. Insulation portions 17 and 18 comprise the solid dielectric of the stripline arrangement and 19 is the typical center conductor strip which will be seen to be connected to loop leg 20. The coaxial connector 12 is one of the plurality of second or rotating ports shown as 12, 13, 14 and 15 etc., on FIG. 1A. A metal or metalized top strip 49 covers the upper end of the dielectric 17 and 18 with a clearance opening for the stripline conductor 19 which connected to the center conductor of the coaxial fitting 12. The outer conductor of coaxial connector 12 is returned to the two, conductive, cylindrical shells 32 and 33 which comprise the ground planes for the stripline assembly.

Of course, it will be realized that the rotating assembly includes plural circumferentially spaced conductors 19 within the stripline assembly, one for each of the circumferentially distributed, rotating loops 20 depicted in the development of FIG. 2.

Bearings 30 and 31 provide mechanical support and alignment with rotational freedom for the entire rotating assembly 16. It will be realized, however, that since axial and radial alignment and stability of the loop legs 20 and 27 with respect to each other is important in the obtaining of stable and predictable operation of the device. Accordingly, those of skill in this art will realize that additional bearings may be necessary. For example, an additional, radially outward bearing similar to 11 might be provided through the same wall of the housing farther down towards the choke aperture 25. Similarly on the radially inward side, the annular tongue 23 can be of sufficient thickness to provide for a bearing therein. Other expedient's of course are available, such as the provision of a much thicker stripline top plate 49 which might extend radially in both directions over the top ends of housing 11 to provide an additional function of axial constraint as well as electrical continuity between the outer conductor of coaxial connector 12 and the conductive cylindrical walls 32 and 33. Since mechanical support and variation thereof are well within the ordinary skill of this art, it is not thought to be necessary to discuss bearing support of the rotating assembly 16 any further.

In order to "close" the annular chamber housing the loops in a radio frequency sense, folded double quarter-wave chokes are built-in to the housing as indicated, these have the effect of producing radio frequency short circuit points at 24 and 25. The choke cavities and tongues 22 and 23 defining these cavities are of course annular in shape extending the full 360° in the plane normal to the center line of mast 10 in FIG. 1. The operation of folded double quarter-wave choke devices is well understood in art of microwave devices.

Figure 1A:
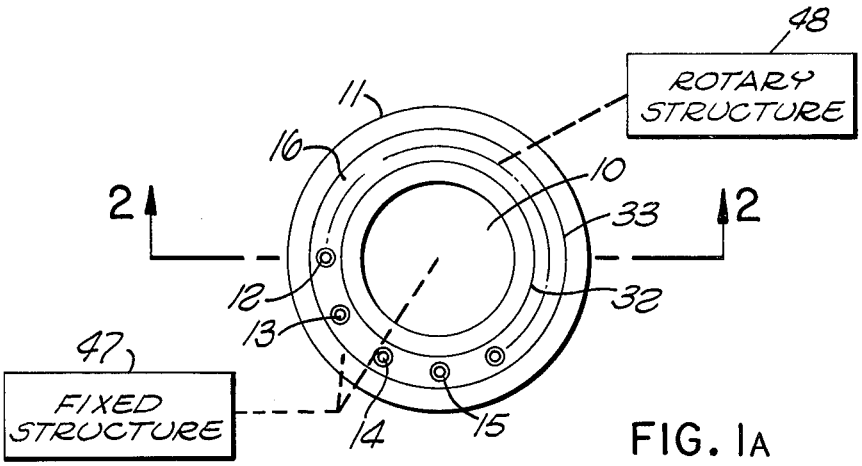
FIG. 1A is a top view of FIG. 1 in non-sectioned form but showing the sectioning plane applicable to FIG. 1.

In FIG. 1A the conductive cylindrical shells which form the ground planes for the upper or stripline assembly portion of the rotating assembly 16 are depicted. The blocks 47 and 48 are merely intended to indicate attachment to fixed and rotating structure respectively. That is, 47 represents the fixed structure of the ship or other platform to which the mast 10 is affixed. Block 48 represents the rotating structure including the antenna array which would be mounted on the mast 10 above the rotary coupler of the invention as depicted in FIG. 1, the rotating structure of 48 also including whatever drive and support structure would be normally included.

Also shown in FIG. 2 is a method for equal phase or equal path length summation of all the individual loop energy transfers. A plurality of first fixed couplers, for example four-port, coaxial type couplers include 39 and 40 in a first group and 37 and 38 in a second group, the latter mechanically rotating with the rotor loops such as 20. Couplers 39 and 40 effectively couple in series into a first main line 42 which has a termination 41 and a stationary main line port 43, and individually connect, for example, by leads 34 and 36 (coaxial cable normally), to fixed loop legs 27 and an adjacent fixed loop in the manner already described in connection with FIG. 1. Similarly the rotating ports connected to rotating loops such as 20 and an adjacent one thereto are connected by leads 33 and 35 (also coaxial cable typically) to four-port coaxial couplers 37 and 38 respectively. Thus the second main line 44, which physically rotates with the entire rotating superstructure in cooperation with the coaxial couplers 37 and 38 etc., provides the combination or division of energy so that 45 becomes a rotating port connectable to the antenna which is a part of the rotating superstructure. The second main line 44 also has a termination or load 46.

It will be noted that in the showing of FIG. 2, the rotating loops comprise narrower loop legs such as 20 as compared to the typical fixed loop leg 27. This reduces the rotational inertia while limiting flutter in the overall power transfer between the terminals 43 and 45 to an acceptable level. Since the configuration of the interconnecting coaxial cable including 33, 35, 34 and 36 is intended to avoid phase disparity among the individual paths between 43 and 45, it follows that some signal energy phase disparity can exist between adjacent fixed and adjacent rotating loops, however this is not a significant consideration and accordingly the fixed loops may be designed with greater relative width and lesser circumferential spacing than implied on FIG. 2, that tending to reduce the aforementioned power transfer flutter.

In FIG. 1, it will be noted that the return paths for the loop legs, such as 20 and 27 are through the conductive cylindrical shell 21 and the radially inner portion of the housing 11. Thus while the loop legs such as 20 and 27 are discrete, the return paths are mingled in the conductive shell 21 and housing 11 respectively.

Basically, the loop legs 20 and 27 including conductive pedestals 26 and 11A are electrically one-quarter wavelength, axially measured, however the dimensioning is not critical and small variations within ordinary mechanical tolerances are not of great significance.

In lieu of the stripline arrangement of the upper (second) axial section of the rotating assembly 16, a coaxial line between 12 and the rotating loop leg 20 might be employed as a variation. In that case, the dielectric 17 and 18 of the stripline configuration might be replaced by solid metal, with axial bores, the internal walls of which would provide the outer condutors for the coaxial transmission lines thereby formed with 19 etc., as its center conductor. The illustrated stripline structure is preferred from the point of view of ease of construction and overall lightness, since a low-density, dielectric medium can be employed at 17 and 18.

From an understanding of the invention it will be realized that the fixed loops can be placed adjacent the radially outward wall of the housing 11 rather than the radially inward wall as illustrated. In that alternative situation, the rotating loops are similarly reversed, their loop return paths being provided by a cylindrical conductive shell extended from 32 rather than 33.

Either the stripline or coaxial line medium between coaxial connector 12 and the loop leg 20 can be easily designed for an impedance match to the impedance presented by the loop. The factors affecting loop impedance include loop width, ground plane spacing and coupling to a loop of the other set (fixed or rotating). The practitioner of skill in this art can select the parameters of a particular design to provide proper impedance matching, which should be optimum when a rotor loop is centered over one of the stator loops. The technical literature including a paper entitled "Characteristic Impedance of Broad Side Coupled Strip Transmission Lines" by S. Cohn (IEEE Transactions MTT., Vol 8, pp 633–637), summarizes the analytical approach through which specific loop parameters may be determined. In one embodiment of the invention, the convenient loop characteristic impedance of 50 ohms was selected, this being readily consistent with the impedances out through the coaxial connectors, typically 12 and 29.

Figure 3:
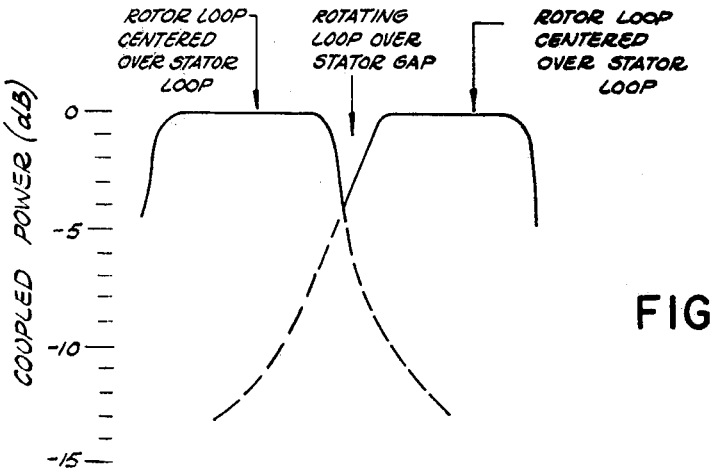
FIG. 3 is a plot of adjacent loop, coupling in the device of FIGS. 1, 1A and 2.

FIG. 3 is self explanatory in depicting the effect of relative rotational position between given rotor and stator loops. Circuit accommodations may be made if necessary, to avoid the point illustrated at which the coupling falls below 3*d*B.

Modifications and variations will suggest themselves to those of skill in this art, once the invention is understood, accordingly, it is not intended that the invention should be regarded as limited to the specific embodiment illustrated and described.

What is claimed is:

1. An around-the-mast rotary coupler for transferring radio frequency signals between a rotating antenna system or the like and physically fixed circuit apparatus comprising:

a generally axially-elongated housing of cylindrical outer shape and of annular cross-section having a generally cylindrical central axial opening whereby said housing may be mounted with said mast passing generally coaxially through said cylindrical opening;

a first plurality of fixed elongated conductive loops extending generally axially within a first axial portion of the axial length of said housing and uniformly distributed circumferentially, said fixed conductive loops having their axial centerlines mutually parallel;

a plurality of first ports one for each of said first loops discretely providing external connection to each of said first loops;

a rotatable assembly within said housing comprising a plurality of second axially elongated conductive loops mounted on said rotatable assembly in a second uniformaly spaced circumferential arrangement, the lateral dimensions of said first and second loops being tangent to respective concentric circles of different radius, said first and second loops thereby maintaining an electromagnetic coupling relationship as said rotatable assembly is rotated about the centerline of said axial opening;

and a plurality of second ports mounted on said rotatable assembly, one for each of said second loops discretely providing an external connection to each of said second loops.

2. Apparatus according to claim 1 in which said first and second conductive loops are defined as having their axial centerlines substantially parallel to the axial centerline of said central axial opening.

3. Apparatus according to claim 1 in which said rotating loops have smaller lateral dimensions than said fixed loops, the gaps between adjacent fixed loops measured circumferentially about said circle of tangency being small compared to the lateral dimension of each of said fixed loops, thereby to minimize rotational inertia and variations of coupling as said rotatable assembly is rotated.

4. Apparatus according to claim 1 in which said pluralities of first and second loops are distributed about the full 360° in a plane normal to the axis of said central axial opening.

5. Apparatus according to claim 1 in which said rotatable assembly comprises two axial sections, the first of which includes said plurality of second loops and the second of which includes transmission line means for providing a feed for each loop of said second plurality of loops.

6. Apparatus according to claim 5 in which said transmission line comprises a stripline assembly having inner and outer ground planes each in the form of a concentric cylindrical shell of conductive material and a discrete center strip within said dielectric connected to each of said second loops on one end thereof and to a corresponding one of said second ports at a second end, said strips being distributed and spaced circumferentially in a pattern corresponding to that of said second loops radially midway between said cylindrical shells.

7. Apparatus according to claim 6 in which said second ports are coaxial connectors each of which has its center conductor connected to a corresponding one of said strips and having its center conductor connected to said ground planes.

8. Apparatus according to claim 7 in which bearings are included and are operative between said housing and said cylindrical shells of conductive material for maintaining axial and radial alignment of said rotatable assembly while permitting rotational freedom.

9. Apparatus according to claim 6 in which said center cylindrical shell is axially elongated through the axial dimension of said first axial section of said rotatable assembly, whereby said shell provides a conductive path constituting one axial leg of each of said second loops.

10. Apparatus according to claim 1 further including first and second transmission mainlines having corresponding first and second mainline terminals at which signal energies within said first and second pluralities of ports are summed respectively, and including first and second transmission mainlines, first and second mainline terminations, said mainlines each extending between the corresponding mainline terminal and termination, first and second pluralities of in-line couplers associated with a corresponding one of said mainlines, and first and second pluralities of interconnecting transmission lines, one for each of said first and second ports and in-line couplers, and connected to provide signal summation of discrete signal magnitudes through each of said loops.

11. Apparatus according to claim 4 further including first and second transmission mainlines having corresponding first and second mainline terminals at which signal energies within said first and second pluralities of ports are summed respectively, and including first and second transmission mainlines, first and second mainline terminations, said mainlines each extending between the corresponding mainline terminal and termination, first and second pluralities of in-line couplers associated with a corresponding one of said mainlines, and first and second pluralities of interconnecting transmission lines, one for each of said first and second ports and in-line couplers, and connected to provide signal summation of discrete signal magnitudes through each of said loops.

12. Apparatus according to claim 10 in which each of said interconnecting transmission lines is of a predetermined length such that no differential phase shift occurs in the signal paths through said loops.

* * * * *